United States Patent [19]

Sweet

[11] 4,096,833

[45] Jun. 27, 1978

[54] CIRCUIT FOR FREQUENCY MODULATED FUEL INJECTION SYSTEM

[75] Inventor: Charles R. Sweet, Royal Oak, Mich.

[73] Assignee: The Bendix Corporation, Southfield, Mich.

[21] Appl. No.: 729,070

[22] Filed: Oct. 4, 1976

[51] Int. Cl.[2] ..... F02B 3/00

[52] U.S. Cl. ..... 123/32 EA; 123/32 ED; 123/32 EG

[58] Field of Search ..... 123/32 EA, 32 EG, 32 ED, 123/32 EH

[56] References Cited

U.S. PATENT DOCUMENTS

| | | | |
|---|---|---|---|
| 3,699,931 | 11/1972 | Cinquegrani | 123/32 EA |
| 3,727,081 | 4/1973 | Davis et al. | 123/32 EA |
| 3,759,231 | 9/1973 | Endo | 123/32 EH |
| 3,780,587 | 12/1973 | Rivere | 123/32 EA |
| 3,786,788 | 1/1974 | Suda et al. | 123/32 EA |
| 3,822,679 | 7/1974 | Hobo et al. | 123/32 EA |
| 3,935,851 | 2/1976 | Wright et al. | 123/32 EA |
| 4,010,717 | 3/1977 | Taplin | 123/32 EH |

*Primary Examiner*—Charles J. Myhre
*Assistant Examiner*—Parshotam S. Lall
*Attorney, Agent, or Firm*—Gaylord P. Haas, Jr.

[57] ABSTRACT

A frequency modulated control circuit for an electronic fuel injection system to control the pulse-type injection of fuel at a single point of the fuel intake of an internal combustion engine in accordance with the derived mass air flow rate into the engine comprising a pressure sensor for sensing the manifold pressure of the internal combustion engine, and an engine speed sensor, both of which generate an analog signal which is multiplied by a multiplier circuit to provide a signal representative of the mass air flow to the engine. The multiplier circuit includes a separate control input for varying the output signal level of the multiplier circuit by a preselected factor determined by the final output of the control circuit. The output of the multiplier circuit is fed to a voltage controlled oscillator to produce an output signal taking the form of a pulse train, the frequency of which varies with the amplitude of the mass air flow signal. The output of the voltage controlled oscillator is fed to a pulse generator which generates a fixed on-time pulse for each pulse in the pulse train being fed from the voltage controlled oscillator. The output of the pulse generator is sensed by a duty cycle switch which senses when the output frequency of the voltage controlled oscillator results in a high duty cycle for the output pulses. In this high duty cycle situation, the output analog signal of the multiplier is reduced by a preselected fraction. The duty cycle switch also generates an output signal which varies the duration of the pulse output from the pulse generator as a reciprocal of the variation being applied to the multiplier from the duty cycle switch or enable a secondary injector.

The system also includes a temperature sensor and coolant temperature circuit which generates an analog voltage signal which varies as a function of the engine coolant temperature. The temperature analog signal, designated $\overline{V_{H_2O}}$, is fed to a cold start circuit to control the output pulse width from the cold start circuit.

16 Claims, 8 Drawing Figures

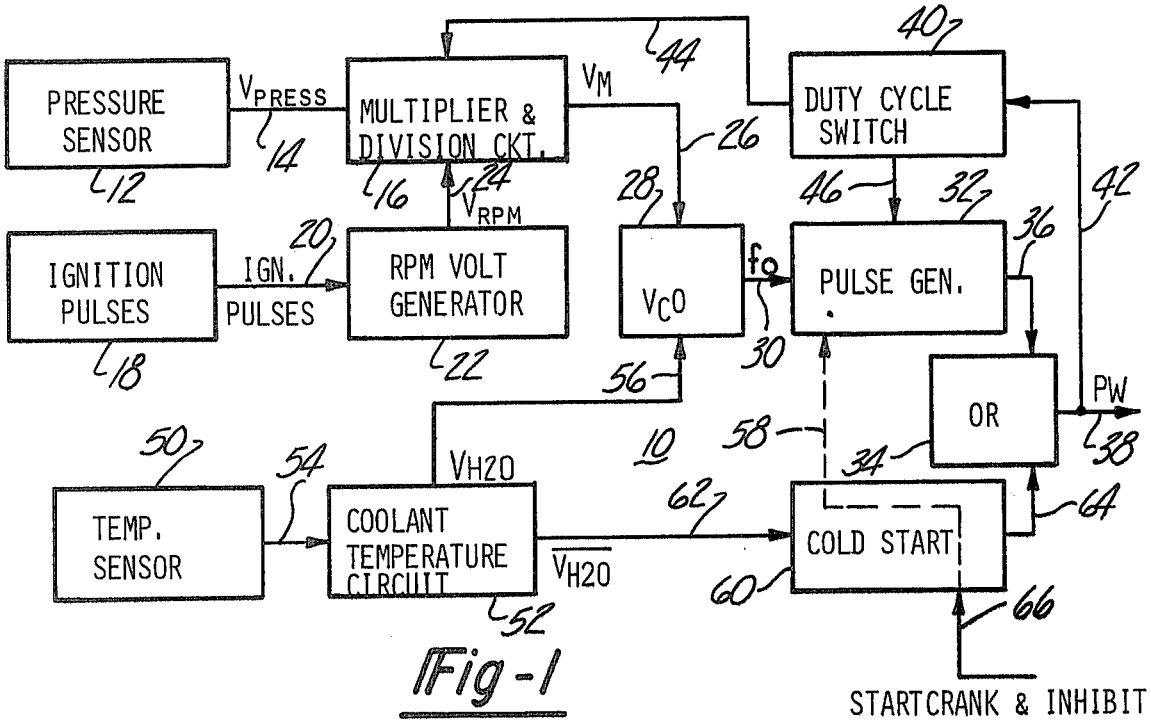
Fig-1
Fig-2
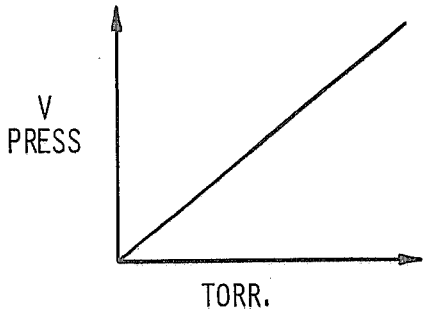
Fig-3
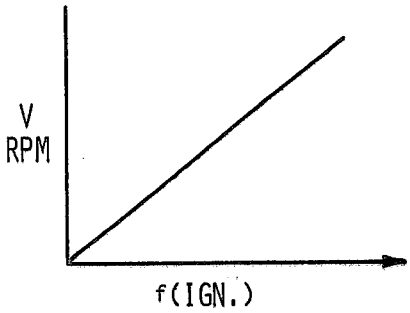
Fig-4
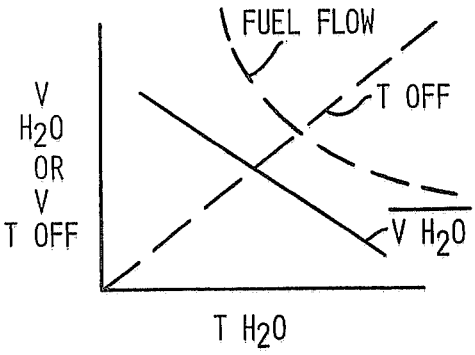
Fig-5
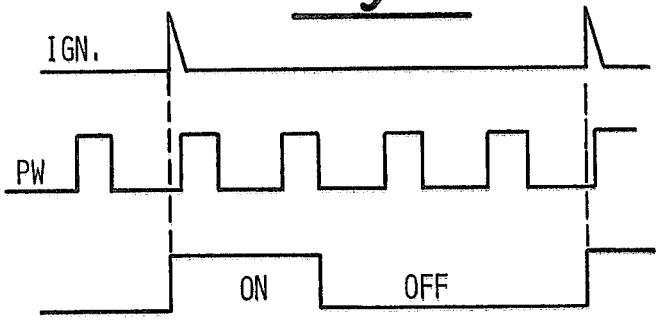
PRIOR ART

CIRCUIT FOR FREQUENCY MODULATED FUEL INJECTION SYSTEM

BACKGROUND AND SUMMARY OF THE INVENTION

This invention relates generally to an electronic fuel injection control system and more specifically to an electronic fuel injection control system wherein the pulses controlling the injection of fuel into the engine are frequency modulated and asynchronous with engine speed.

In conventional fuel injection systems, fuel is metered to the engine according to certain engine parameters which are sensed by suitable sensing means. Typically, the quantity of intake air per cycle of the engine is sensed by a suitable manifold pressure sensor positioned in the intake manifold of the engine. Thus, the fuel is metered in accordance with the sensed manifold pressure, this pressure determining the length of the injection pulse, and fuel is supplied to the engine in sychronism with engine rotation. Typically, the above described system is utilized in connection with a multiple point fuel injection system but may also be applicable to a single point fuel injection system wherein fuel is injected at a single point for multiple cylinders upstream of the fuel charge intake for the engine.

However, in the single point injection for controlling the injection of fuel into the engine as described above, it has been found that stratification between fuel and air occurs whereby, during a given period, a series of fuel pockets occur between pockets of air forming the remainder of the fuel charge. This is due to the long period of on-time and off-time which occurs when a single pulse is utilized to inject fuel into the engine. Further, with a single pulse being injected into each cylinder for each engine cycle and a pulse is missed for any cylinder of any cycle, that pulse occurring at a later time, the engine for that cycle will be 100% lean in that no fuel will be inserted into the fuel/air charge and, upon occurrence of the subsequent pulse, will create a situation of a 100% rich mixture in that two pulses are being fed into the cylinder for an engine cycle rather than one as required.

Further, as is seen from the description above, the control of the fuel being fed to the engine occurs by controlling the pulse width of each pulse being fed to the engine. Accordingly, for small variations from the stoichiometric or other desired operating point, small variations in pulse width will occur. It has been found that a degree of difficulty and inaccuracy enters into the control of the required pulse width or on-time for the injector to achieve a certain operating point when the pulse width modulation system is being used. This difficulty is made more acute when the pulse widths are small, as for example in the idle and light load conditions, and it is these operating conditions which creates the greatest pollution problem with respect to emissions from the engine. However, at high loads the pulse width modulation system is relatively accurate due to the long duration of the pulses being fed to the injector system. However, polluting types of emissions are of no great concern at these operating levels in view of the fact that this point of operation occurs less often in the engine operation.

It has been found that the injector accuracy deteriorates rapidly at pulse widths smaller than 1.5 to 2 milliseconds and it is desirable to select a minimum pulse on-time to be somewhere between 2.5 milliseconds to 4 milliseconds. With the minimum on-time duration selected in this range, it has been found that the injectors will respond with sufficient rapidity to maintain engine fuel flow in sufficient quantities to operate at the stoichiometric point or other selected operating point.

In the patent to Toshi Suda et al, Pat. No. 3,786,788, issued Jan. 22, 1974, there is proposed a fuel injection apparatus for an internal combustion engine, the apparatus including a throttle position sensor which produces an analog signal representative of the throttle position and thus air velocity to the engine if the configuration of the air conduit is known. This throttle position sensor provides a signal to an astable multivibrator circuit, the output frequency of which varies as a function of variations in the throttle position signal. This output frequency signal is fed to a pulse shaping circuit for modifying the shape of the pulse without altering the frequency of the pulse train.

The output of the shaping circuit is fed to a monostable multivibrator which provides an output pulse train having a fixed on-time and an off-time which varies as a function of the frequency of the pulse train being fed thereto from the shaping circuit. The output of the monostable multivibrator is fed to a current driver circuit which, in turn, is connected to control the solenoid valves associated with the injectors.

This prior system has certain inherent disadvantages in that the control unit for controlling the injection pulses to the injectors utilizes a sensing system which includes only sensing an indication of the velocity of the air flow to the engine. Particularly, there is utilized a throttle position sensor, which sensor generates a throttle position analog signal to control the frequency output of the astable multivibrator described above. Accordingly, there is no provision for sensing the mass of the air flow to the engine.

Further, the aforementioned system disclosed in the Toshi Suda et al patent relates to a multi-point injection system rather than a single point injection system which unduly shortens the pulse duration of each of the injection pulses being fed to the respective cylinders of the engine. Finally, there is no provision in the Toshi Suda et al patent disclosure for modifying the pulse generation circuitry in the event that the pulses become so extremely short in duration as to make accurate control of the injectors a substantial problem.

The system of the present invention has been designed to alleviate the problems noted above. In a preferred embodiment of the invention, a system incorporates a manifold absolute pressure sensor which senses the pressure in the intake manifold of the engine under consideration. The output of the pressure sensor is an analog voltage signal, the amplitude of which varies as a function of manifold absolute pressure. The system further includes a sensor for sensing ignition pulses to provide an analog signal representative of the engine speed. This analog engine speed signal, as is the analog pressure signal, is fed to a multiplier circuit which produces an analog output voltage directly proportional to the mass of the air being supplied to the engine per unit time.

The output from the multiplier circuit is fed to a voltage controlled oscillator, the voltage responsive oscillator producing a stream of output pulses having a frequency which is directly proportional to the analog voltage signal representing the mass air flow. Accordingly, the system as thus described produces a variable frequency signal which is representative of a preselected relationship between the magnitude of manifold pressure and frequency of ignition pulses. However, the pulses from the oscillator are voltage spikes, not the pulses required in a fuel injection system of this type. Accordingly, the output of the voltage controlled oscillator is fed to a pulse generator which is capable of producing output pulses in response to an input pulse, the output pulses each having a duration which is extremely accurately controlled. Also, amplitude of the output pulses from the pulse generator are similarly accurately controlled. From the foregoing, the output of the pulse generator is seen to be a stream of pulses having a fixed duration and a fixed amplitude, the off-time varying as an inverse function of the frequency signal being fed from the voltage controlled oscillator. It is these output pulses which are utilized to control the operation of the injector.

In one embodiment of the system of the present invention, it is contemplated that the injector assembly will include a primary and secondary injector which injects fuel into the fuel system of the engine at a single point. This point may vary from engine to engine depending upon the particular type of fuel system selected for that engine.

In the above referenced Toshi Suda et al patent, there is no teaching of a method or manner in which the control of the injection system may be varied in accordance with the output pulse conditions present at the injectors. For example, if the pulses being supplied to the injectors are sufficiently close together indicative of a high frequency being fed from the astable multivibrator, control of the injectors may be lost due to the fact that the injectors are incapable of operating at the frequency being generated by the multivibrator. Further, there is no disclosure in Toshi Suda et al as to how the output pulse width from the monostable multivibrator may be varied in accordance with any variable features incorporated into the multivibrator.

This analog pressure signal and the analog engine speed signal are designated $V_{pres}$ and $V_{rpm}$ and the resultant output analog signal from the multiplier varies as a direct function of the product of the $V_{pres}$ and $V_{rpm}$ signals. The multiplier also includes a further input which is fed back from the output of the control circuit to control a divider circuit associated with the multiplier circuit. This function will be explained more fully hereinafter.

The output analog signal from the multiplier circuit, designated $V_m$, controls a voltage controlled oscillator to generate a frequency signal, the control of the frequency being directly related to variations in either the pressure sensor or engine speed or both. Therefore, the frequency modulated signal varies as a function of the mass air flow to the engine, the mass air flow being related to the manifold absolute pressure and the rotary speed of the engine. These output pulses from the voltage control oscillator are not controlled as to amplitude and pulse duration, which function is performed by a pulse generator which is connected downstream from the voltage controlled oscillator. The pulse generator, when provided an input pulse, will provide an output pulse having a precisely controlled amplitude and pulse duration for the on-time with a variable off-time varying as an inverse function of the frequency being generated by the voltage controlled oscillator. Thus, the duty cycle of the output pulse train from the pulse generator varies as a direct function of the frequency output from the voltage controlled oscillator. This output pulse train is fed through an OR gate to an output terminal connected to the solenoid associated with the injectors, the on-time of the pulses from the pulse generator determining the on-time for the injectors.

With the system described above, there has been provided a frequency modulated control circuit for a single point fuel injection system, the frequency of which is controlling the duty cycle of the pulses being fed to the injectors as a function of the mass air flow to the engine. In this way, the variable operational parameters of the engine are sensed to provide control for the injectors. In engines of the type normally utilizing an injection system, the fuel requirement increases as a function of increased engine load and/or increased engine speed. Accordingly, both engine functions are sensed to provide control for the duty cycle of the pulse train, contrary to certain systems of the prior art.

A problem may arise if the engine is operating under load at high speed and the duty cycle of the output pulses from the pulse generator approaches a preselected percentage, for example, 80%. In this situation, the injectors will be on for a relatively long period of time and would be turned off for an extremely short period of time, whereupon they would again be turned on. With this high duty cycle, it is possible that the inertia of the injector be so great as to cause the injector to fail to turn off or partially turn off and the injectors may unduly wear. Accordingly, the system of the present invention senses the duty cycle of the output pulses being fed to the injectors and, upon the duty cycle reaching a pre-selected value, will operate a duty cycle switch to provide an output signal which is fed back to the multiplier circuit. This output signal operates on circuitry associated with the multiplier circuit to reduce the effective output of the multiplier in response to pressure and ignition pulse changes by a preselected factor, for example, one-half or one-third. The duty cycle switch also generates an output signal which is fed to the pulse generator to increase the pulse length being produced by the pulse generator as an inverse function of the reduction of the output multiplier voltage. For example, if the output multiplier voltage is reduced by one-half for preselected pressure and ignition pulse sensor outputs, the pulse length would correspondingly be increased by a factor of two. In this way, the amount of fuel being fed to the engine is maintained at a constant rate for a preselected pressure and engine speed while at the same time maintaining continuous accurate control over the operation of the injector. In this way the injector life may be extended.

It has been found that additional fuel requirements arise in an engine operating at a low temperature and during cranking. With regard to the cranking situation, a temperature sensitive pulse generation circuit has been provided which is responsive to engine temperature and the cranking condition. The output pulses from this circuit are fed to the OR gate to control the injector during engine cranking operation.

Accordingly, a temperature sensor is provided which produces an output signal corresponding to the engine temperature, this signal being fed to a coolant temperature circuit which generates an analog output signal in the form of a voltage, the amplitude of which is directly related to the engine temperature ($V_{H_2O}$) and indirectly related ($\overline{V_{H_2O}}$). This $V_{H_2O}$ signal is fed to the voltage controlled oscillator circuit to provide a reference voltage for the oscillator circuit to compare with the mass air flow signal $V_m$, and to a cold start circuit, $\overline{V_{H_2O}}$, which generates output pulses having a preselected length and duration, this duration being greater than the duration of the pulses being fed from the pulse generator to the OR circuit. The cold start circuit also includes an enable signal designated "start crank" which enables the cold start circuit during cranking and inhibits the pulse generator circuit. At the end of cranking, the cold start circuit is inhibited and the pulse generator circuit is enabled.

Accordingly, it is one object of the present invention to provide an improved electronic fuel injection system of the frequency modulated type which is responsive to the mass air flow to the internal combustion engine.

It is another object of the present invention to provide an improved electronic fuel injection system which includes a means for sensing the mass air flow to the internal combustion engine and provide the engine with a plurality of fuel injecting pulses asynchronously therewith, the system further including a means for modifying the mass air flow signal in accordance with the frequency of the pulses being fed to the engine fuel system.

It is still another object of the present invention to provide an improved control for the fuel supply of an internal combustion engine to obtain an optimum fuel-air ratio without synchronizing the fuel supply with the engine speed.

It is still another object of the present invention to provide an improved fuel injection control system wherein the injection of fuel to the internal combustion engine is controlled by means of a frequency modulated pulse train, the frequency of which varies in response to the mass air flow being fed to the engine.

It is still a further object of the present invention to provide an improved fuel injection system of the type described which further includes a means for modifying the injection pulses being fed to the internal combustion engine in accordance with the sensed engine coolant temperature.

It is still another object of the present invention to provide an improved internal combustion engine fuel control system which is inexpensive to manufacture, reliable in use and achieves a desired optimum air fuel ratio.

Further objects, features and advantages of the present invention will become readily apparent from a consideration of the following description, the appended claims and the accompanying drawings in which:

BRIEF DESCRIPTION OF THE DRAWINGS

FIG. 1 is a block diagram illustrating certain features of the preferred frequency modulated fuel injection system of the present invention;

FIG. 2 is a graph illustrating the relationship of voltage to sensed manifold pressure which is supplied to the control system of FIG. 1 by the manifold pressure sensor;

FIG. 3 is a graph illustrating the relationship of ignition frequency to the analog voltage supplied by the ignition pulse sensor of FIG. 1;

FIG. 4 is a graph representing the relationship between engine temperature to the amount of fuel flow to the engine, the analog voltage signal generated by the temperature sensor in response to the sensed temperature and the duration of time between pulses (off-time) of the pulse train supplied to the injectors in response to sensed engine temperature;

FIG. 5 is a partial timing diagram illustrating the relationship between injector pulse width of prior art systems and the train of injector pulses of the present system with reference to ignition pulses;

DETAILED DESCRIPTION OF THE INVENTION

Figure 6:
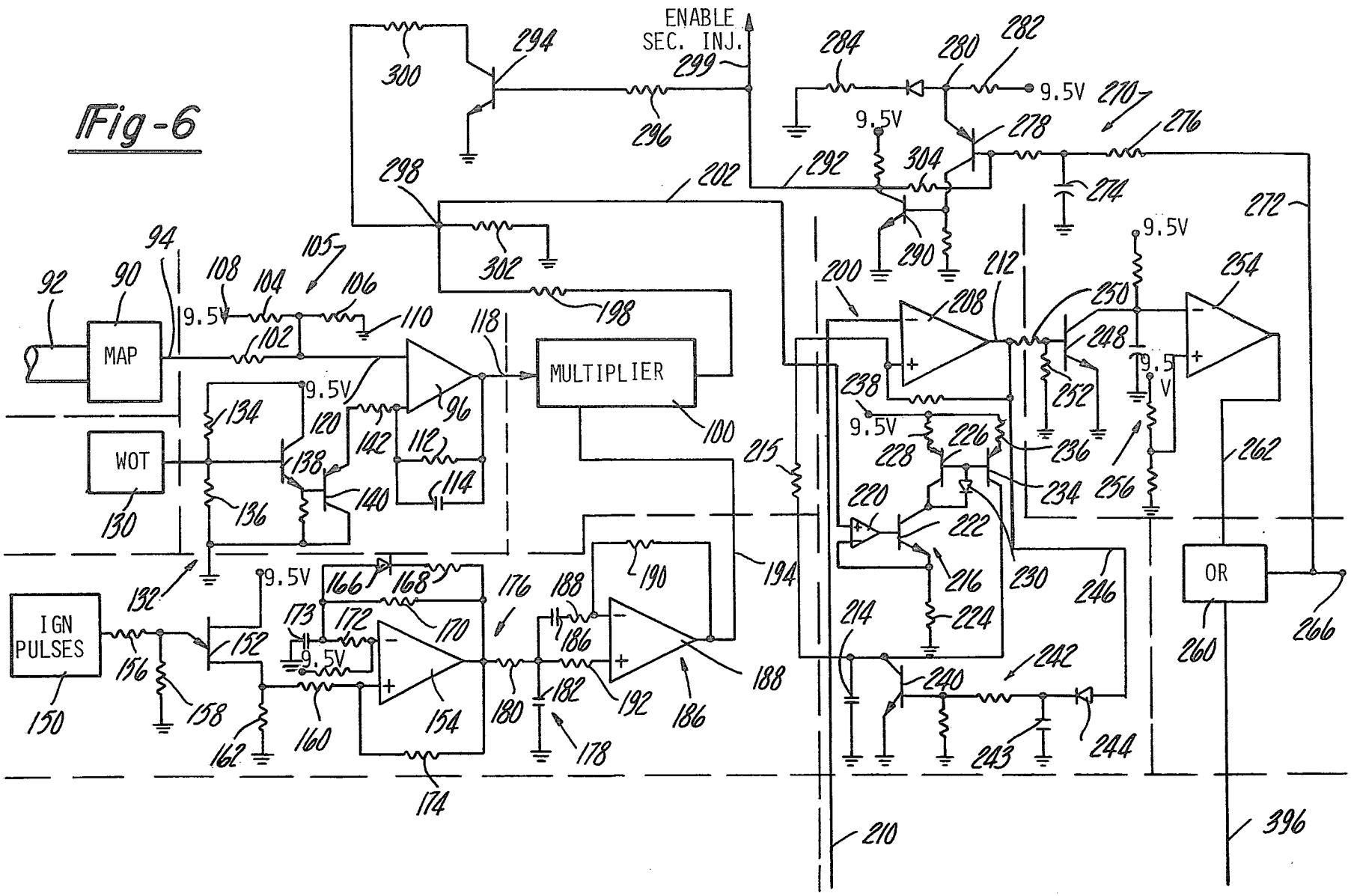
FIG. 6 is a partial schematic diagram illustrating certain details of the block diagram of FIG. 1 and particularly illustrating the input sensors for sensing manifold pressure and ignition pulses, the multiplier circuit, the voltage controlled oscillator circuit, the pulse generator circuit, the output OR gate, and the feedback duty cycle switch.

Referring now to the drawings, and particularly FIG. 1 thereof, there is illustrated a block diagram of an electronic fuel injection control system 10 which is adapted to sense certain operating conditions of the engine being controlled and, in response to those sensed conditions, provide a plurality of pulses to control the ratio of fuel to air in the fuel charge being fed to the engine. In the particular system to be described, it will be noted that the manifold absolute pressure and the frequency of ignition pulses are sensed to produce an output pulse train, the frequency of which varies in accordance with the sensed pressure and engine speed, the pulse train being utilized to control the frequency of injection of fuel into the fuel intake. In the particular system to be described, it will be noted that a single point fuel injection system is utilized. However, it has been understood that multiple point fuel injection systems may also be utilized consistent with maintaining control over the operation of the fuel controlling apparatus.

As was described above, the system of the present invention is a frequency modulation system whereby the sensed manifold pressure and frequency of ignition pulses produce an analog output signal which is converted to a train of pulses having a frequency which is directly related to the product of the sensed pressure and frequency of ignition pulses. This pulse train is operated on by the circuit to produce a plurality of pulses having a fixed on-time and a variable off-time, the off-time varying in accordance with the frequency produced as a result of the pressure and ignition pulse signals.

Thus, the system 10 includes a pressure sensor 12 which senses the manifold absolute pressure and produces an analog output signal in response thereto on a conductor 14, which analog signal is fed to a multiplier circuit 16. The system also includes a means for sensing the ignition pulses being fed to each cylinder of the engine by means of an ignition pulse sensor circuit 18, the ignition pulse sensor circuit producing an analog output signal on a conductor 20 which, in turn, is fed to an engine speed voltage generator circuit 22. The output of the engine speed voltage generator circuit 22 takes the form of an analog signal, designated $V_{rpm}$, on a conductor 24, which is representative of the engine speed. This latter signal is also fed to the multiplier circuit 16. The multiplier circuit may take the form of a common multiplier circuit which is capable of multiplying a first and second analog input signal to produce an output signal which is a product of the two input signals. As will be seen from a description of the system of FIG. 6, the multiplier circuit also includes a divider circuit which is capable of dividing the analog signal, or Vm, at the output of the multiplier by a predetermined integer.

The output of the multiplier circuit takes the form of an analog signal which is representative of the mass air flow to the engine, the mass air flow analog signal being impressed on a conductor 26. This conductor is connected to the input circuit of a voltage controlled oscillator circuit 28, the output of the oscillator circuit producing a pulse train having a frequency $f_o$ which is directly related to the $V_m$ or mass air flow analog signal as compared to the engine coolant temperature, as sensed by a temperature sensor circuit, to be explained hereinafter. This $f_o$ signal is fed by means of a conductor 30 to a pulse generator circuit 32, the pulse generator circuit producing an output pulse having a fixed amplitude and pulse duration for each input pulse from the oscillator circuit ($f_o$). Thus, the duty cycle of the pulse train from the pulse generator will vary as an inverse function of the off-time between pulses generated at the output circuit of the pulse generator, this off-time, designated $T_{Off}$, varying as an inverse function of $f_o$. The output of the pulse generator circuit 32 is fed to an output OR gate 34 by means of a conductor 36, the output of the OR gate being fed to an output terminal 38 connected to the injector or injectors of the electronic fuel injection system. In this way, the injector will be opened each time that a pulse is generated by the pulse generator and will be closed for the duration of the off-time between pulses generated by the pulse generators 32.

As statd above, a control problem may arise in the system of the present invention if the duty cycle of the output pulses, designated PW, is too great to enable the injector to closely follow the output of the pulse generator. For example, if the duty cycle approaches, for example, 80%, it is possible that the injectors will unduly wear. Accordingly, it has been found to be desirable to modify the circuit to decrease the frequency $f_0$ by a preselected factor and either increase the pulse duration of the output pulses from the pulse generator by an inverse function of that factor or enable a secondary injector which would then be controlled by the output pulses. For example, in the former case, if the output of the multiplier circuit 16 is decreased by a factor of one-half, the output pulse duration of the on-pulses from the pulse generator will be increased by a factor of two. The block diagram of FIG. 1 will be described with the former modification and the schematic of FIG. 6 will be described with the latter modification.

To this end, a duty cycle switch 40 senses the output pulses at terminal 38 by means of a signal impressed on conductor 42. If the duty cycle of the pulses of conductor 42 is above a pre-selected amount, for example 80%, the duty cycle switch 40 will produce an output signal on a conductor 44 which is connected back into the input of the multiplier circuit 16. The multiplier circuit 16 includes an input terminal which, when a voltage is impressed thereon, will divide the signal generated by multiplying the signal on conductor 14 ($V_{pres}$) and the signal conductor 24 ($V_{rpm}$). Accordingly, if the product of the two analog signals on conductors 14 and 24 is a specific amount for a particular manifold pressure and engine speed, the signal on conductor 44 will cause the output signal on conductor 26 to decrease by a factor of, for example, one-half. Simultaneously, the duty cycle switch also produces a signal on a conductor 46 which operates on the pulse generator circuit 32 to increase the duration of the on-pulses generated by the pulse generator by a factor of two. Thus, while the pulses generated by the pulse generator circuit 32 occur at one-half the rate that they previously occurred for a given manifold pressure and engine speed, the generator produces an on-pulse having a duration of twice as long as the previous pulses for the given manifold pressure and engine speed. Accordingly, the amount of fuel fed to the engine for each given pulse from the pulse generator will be proper for the given engine speed and sensed manifold pressure. However, the off-time will also be correspondingly doubled, i.e. the off-times will be increased in duration due to the decreased frequency.

As a further modification, the system includes a cold start circuit wherein the engine temperature is sensed by a temperature sensor 50 which provides an output signal to a coolant temperature circuit 52 by means of a conductor 54. The output of the coolant temperature circuit takes the form of an analog voltage, designated $V_{H20}$ and is fed to the voltage controlled oscillator circuit 28, by means of conductor 56 to provide the reference voltage for the oscillator to compare to the mass air flow signal $V_m$. If the injection control system is not synchronized with the engine, then it is necessary to inhibit either the voltage control oscillator or to inhibit the pulse generator circuit 32 if the engine is cranking, this latter inhibit being illustrated in FIG. 1 by means of an inhibit signal on conductor 58. This inhibit signal ends when the engine starts or cranking the engine is discontinued.

Another output of the coolant temperature circuit 52, $\overline{V_{H_2O}}$, is also fed to a cold start circuit 60 by means of a conductor 62, the amplitude of the voltage on conductor 62 controlling the on-time of output pulses generated from the cold start circuit. The cold start circuit 60 is operated during the cranking period, the period when the large quantity of fuel is required to initially start the engine. The cold start circuit 60 generates a train of output pulses, the frequency of which varies directly as a function of the amplitude of the analog signal conductor 62 designated $\overline{V_{H_2O}}$. The pulse duration of the on-pulses from the cold start circuit 60 is fixed as is the amplitude. However, the off-time will vary in accordance with an inverse function of the amplitude of the signal impressed on conductor 62.

The output of the cold start circuit is also fed to the OR gate 34, whereby the pulses generated in the cold start circuit are fed to the output terminal 38 through a conductor 64 and the OR gate 34. As was stated above, the cold start circuit 60 is operative during the cranking period and the cold start circuit is enabled by means of a start crank signal fed to the cold start circuit by means of a conductor 66. This start crank signal is initiated from the cranking circuit of the internal combustion engine being controlled, the cold start circuit being enabled by this signal generated on conductor 66. This crank signal is also utilized to provide a disable signal for the voltage controlled oscillator and/or the pulse generator. The absence of the start crank signal reestablishes the operation of the oscillator and/or pulse generator circuit at the end of cranking.

Figure 7:
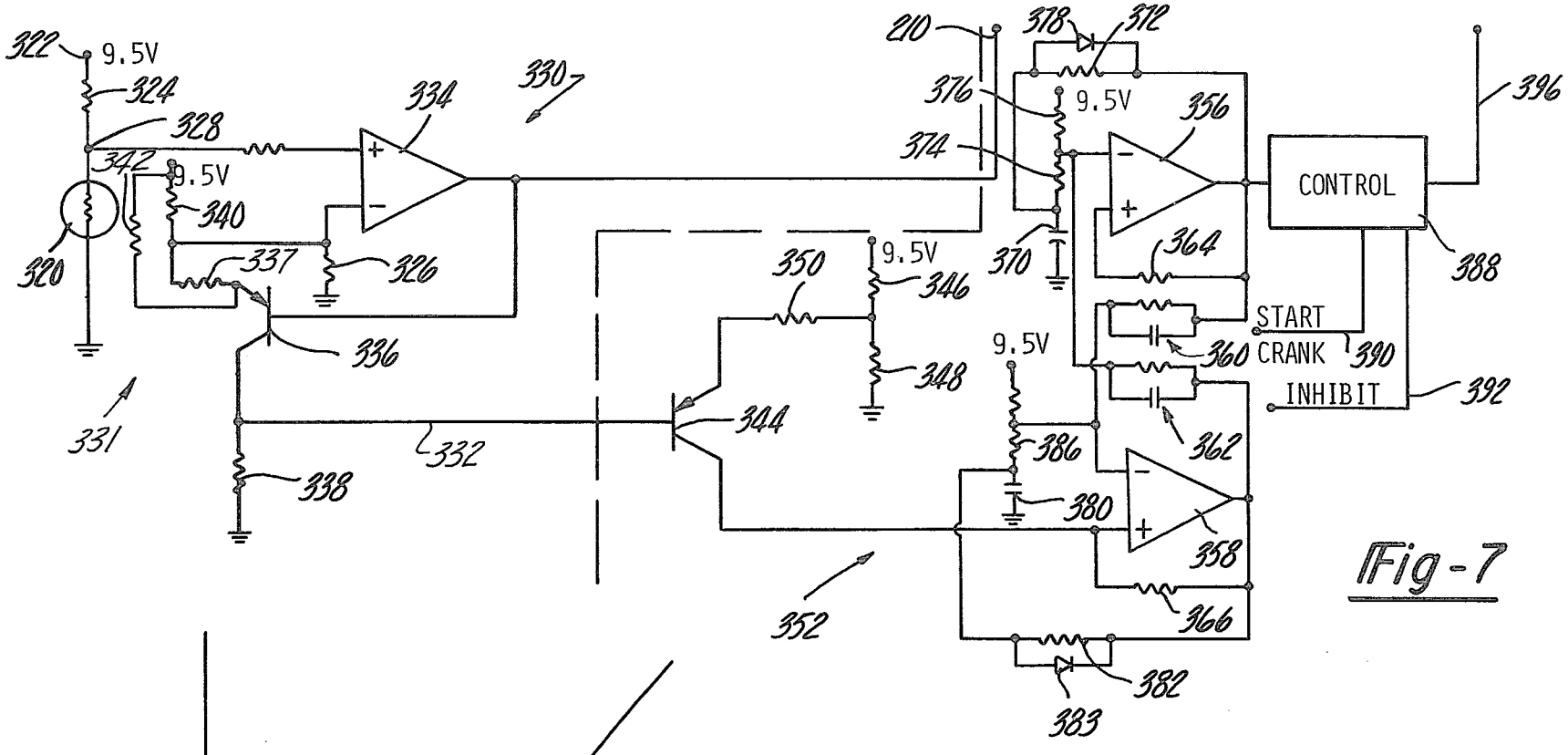
FIG. 7 is the remainder of the schematic diagram illustrating the details of the block diagram of FIG. 1 particularly illustrating the cold start circuit.

Referring now to FIGS. 2–5, there is illustrated various graphs to indicate the operation of specific portions of the system of FIGS. 1, 6 and 7.

Specifically, FIG. 2 illustrates the operation of the pressure sensor whereby upon a specific increase in the torr level there is a linear increase in the output voltage generated by the pressure sensor 12. Accordingly, the increase in the pressure sensor output voltage is linear relative to the sensed pressure.

Similarly, the output voltage generated by the RPM volt generator 22 is linear with respect to the frequency of the ignition pulses. This is specifically illustrated in FIG. 3. FIG. 4 illustrates, for one, a linear relationship between the voltage generated by the coolant temperature circuit 52 with respect to the sensed temperature. It is to be noted that the voltage representative of the temperature ($\overline{V_{H20}}$) decreases with increasing sensed temperature. This decreasing linear relationship will become more apparent upon a review of the detailed description of FIG. 7.

Referring now to FIG. 5, there is illustrated the relationship between ignition pulses and the prior art pulses utilized to control the fuel injector or injectors, and the relationship between the prior art output pulses and the pulses being generated by the system of the present invention. Specifically, the uppermost graph of FIG. 5 illustrates the ignition pulses as sensed by the ignition pulse sensor. The lowermost figure, labelled prior art, illustrates the output pulses being fed to the injectors in the prior art systems, these pulses being synchronized with engine speed. This synchronous operation is illustrated by the coincidence of the start of an ignition pulse with the start of the on-pulse of the prior art.

In contrast, the pulse train generated by the system of the present invention is illustrated in the middle of FIG. 5 and labelled PW. It will be seen from a close inspection of this pulse train that the total on-time of the pulses between the start of the first prior art on-pulse and the start of the second prior art on-pulse is equal to the total on-time for a single prior art on-pulse. Also, it will be noted that the sum of the off-times in the PW pulse train is equal to the single off-time illustrated on the prior art curve. Further, the pulses in the PW pulse train are not synchronized with ignition pulses but rather are arbitrarily established relative to the ignition pulses.

Referring now to the details of the preferred embodiment of the present invention, and particularly to those details as illustrated in FIG. 6, there is provided a manifold absolute pressure (MAP) sensor 90 which is coupled to the manifold to sense the pressure of the manifold through a conduit 92. The MAP sensor 90 produces an output analog signal on conductor 94 which is representative of the sensed manifold pressure. This signal is fed to the input circuit of a unity gain operational amplifier 96 which is connected as a buffer between the MAP sensor 90 and a multiplier circuit 100. The analog output signal on conductor 94 is adjusted as to slope by means of a slope trim resistor 102 and the offset of the analog signal representing the manifold pressure is controlled by means of a pull-up resistor 104 and a pull-down resistor 106, the resistors 104, 106 being connected as a voltage divider. Specifically, the resistors 104, 106 are connected between a positive 9.5 volt potential at input terminal 108 and ground at 110. The operational amplifier 96 is connected as a unity gain amplifier by means of a resistor 112 and a capacitor 114 whereby the output voltage level of the operational amplifier 96 at conductor 118 follows the analog voltage being fed to the positive input thereof by means of a conductor 120.

A wide open throttle sensor 130 is provided which senses the wide open throttle condition on the engine being controlled. This sensor is utilized to disable a MAP break-point circuit 132 which is utilized to increase the analog signal representative of the pressure when the sensed manifold pressure increases above a certain torr level, a curve representing the two slope levels being illustrated in FIG. 8. Specifically, the circuit includes a pair of resistors 134, 136 that are connected as a voltage divider to provide the necessary bias for an npn transistor connected as an emitter-follower which is utilized to transfer the voltage between resistors 134, 136 to the base of a transistor 140. The transistor 140 is a pnp transistor having its emitter electrode connected to the inverting input of operational amplifier 96 through a resistor 142.

Thus, during normal operation the transistor 138 is conductive thereby causing transistor 140 to be nonconductive. Upon sensing a wide open throttle condition, the WOT sensor 130 disables the break-point circuit. When the MAP sensor input goes high enough the negative input to operational amplifier 96 increases for given increases in sensed MAP pressure, to cause the emitter of transistor 140 to forward bias and conduct a certain amount of current away from the negative input. This operation is specifically shown in FIG. 8 and will be discussed hereinafter in connection with a discussion of that figure.

The output of the ignition pulse sensing circuit 150 is fed through a unijunction transistor 152 to an operational amplifier 154 connected as a single shot multivibrator circuit. The ignition pulses signifying the firing of a spark plug are fed to the gate electrode of the unijunction 152 by means of a resistor 156, the emitter electrode being connected to ground through a resistor 158. Pulses passing through the unijunction transistor 152 are fed to the noninverting input of the operational amplifier 154 by means of a resistor 160, a second resistor 162 being connected between the junction of base one of unijunction transistor 152 and the resistor 160 and ground.

The circuit 176 is connected as a multivibrator circuit in the conventional sense with a feedback network to the inverting input consisting of a series connected diode 166 and resistor 168 combination and a resistor 170 connected in parallel therewith. The network is connected to the inverting input by means of a resistor 172. Also, a feedback resistor 174 is connected between the output of the operational amplifier and the noninverting input thereto. When a positive spike is fed to the positive input, the output of amplifier 154 swings high. When the output swings high, the current in the feedback resistor 168 maintains the output high and starts to charge a capacitor 173. When the capacitor charges sufficiently such that the negative current equals the positive, the output swings low. The capacitor then discharges through diode 166 and the resistor 168. Thus, constant duration pulses are generated at the output of amplifier 154. Thus, a plurality of fixed amplitude, fixed duration pulses corresponding to the ignition pulses sensed by ignition pulse sensor 150 are fed from the output of the single-shot multivibrator circuit 176 to an RC averaging network 178 consisting of a resistor 180 and a capacitor 182. The signal at the junction of resistor 180 and capacitor 182 will have a certain amount of ripple present because of the type of signal being sensed.

The voltage on the capacitor 182 is fed to a unity gain amplifier circuit 186 in the form of an operational amplitifier 188 having a feedback resistor 190 connected to the inverting input. The voltage at capacitor 182, including the ripple, is a.c. coupled to the inverting input through a capacitor 187 and a resistor 188, the voltage from the capacitor 182, including the ripple, being fed to the non-inverting input by means of a resistor 192. The ripple is cancelled out with the input network configuration. Thus, the circuit 186 acts as a smoothing network to provide an analog output voltage on conductor 194 which is directly proportional to the frequency of ignition pulses being sensed by the ignition pulse sensor 150.

As was stated above, the multiplier circuit 100 multiplies the analog pressure signal at conductor 118 with the analog ignition pulse signal at conductor 194. The multiplier circuit 100 could take the form of any typical multiplying circuit which is capable of multiplying V1 by V2, as for example, model XR-2208 linear multiplier produced by Exar Integrated Systems, Inc. of Sunnyvale, California. The output of the multiplier circuit 100 is fed through a resistor 198 to the input circuit of a voltage controller oscillator circuit 200 by means of a conductor 202.

Specifically, the voltage controlled oscillator circuit 200 includes a voltage-comparator operational amplifier 208 which compares an analog voltage representative of the engine coolant temperature ($VH_2O$) fed thereto by means of a conductor 210. This voltage signal is generated by the circuit illustrated on FIG. 7 and will be described more fully in conjunction with the description of FIG. 7. The output of the multiplier circuit 100 is fed to a current source 216 for charging a capacitor 214, as will be explained below. The voltage on capacitor 214 is fed to the noninverting input of the operational amplifier 208 by means of a resistor 215.

The comparator 208 compares the voltage on capacitor 214 and the engine coolant temperature signal on conductor 210 and, when the signal level at the positive input exceeds the signal level at the negative input, the output of the operational amplifier 208 swings high to produce an output signal which is a train of pulses having a frequency $f_o$ on an output conductor 212. The frequency $f_o$ is determined in accordance with the following formula:

$$f_0 = \frac{V_m}{V_{H_2O}C_{214}R_{224}}$$

where $C_{214}$ is the value of the capacitor 214 and $R_{224}$ is the value of resistance 224. The capacitor 214 is supplied by the current source 216 wherein the current supplied to the capacitor 214 is equal to $V_m$ divided by $R_{224}$.

Specifically, the $V_m$ voltage is fed to an operational amplifier 220 which provides the base-emitter current for a transistor 222 to cause the transistor 222 to conduct. The current conduction of transistor 222 is equal to $V_m$ times a constant, the constant being determined, by the value of resistor 224. With the circuit to be described, the current to the capacitor 214 is sourced rather than sinked. In order to accomplish this, a transistor 226, due to the conduction of transistor 222, is caused to conduct with the main emitter-collector current flowing through a resistor 228. The current through the resistor 228 is the emitter-to-collector current of transistor 226 plus a small emitter-to-base current which is fed back to the collector-emitter circuit of transistor 222 by means of a diode 230. The conduction of transistor 226 will cause a second transistor 234 to conduct, the resistor 236 being identical in value to the resistor 228. Thus, the voltage drop between a source at terminal 238 to the base of transistors 226, 234 is equal as resistors 228 and 236 are equal. Accordingly, the transistor 234 will conduct with the same current through the emitter-collector circuit as is flowing through the emitter-collector circuit of transistors 226. It is this current that is fed to the capacitor 214.

Accordingly, the capacitor 214, is being charged linearly by the source 216. The voltage on capacitor 214 is fed to the noninverting input of comparator 208 by means of the resistor 215. When the output of the operational amplifier 208 swings high, this high signal is used to discharge capacitor 214 through the conduction of transistor 240. The transistor 240 is controlled by a latching network 242 including a capacitor 243 and a diode 244 connected to the amplifier 208 by a conductor 246. Thus, the comparator provides narrow-width positive output spikes at conductor 212 having a frequency $f_o$ which is directly proportional to the analog mass air flow signal and inversely proportional to the temperature of the engine coolant and the capacitance and resistance value of capacitor 214 and resistor 224, respectively.

The spikes on conductor 212 are fed to a single-shot multivibrator circuit including an input transistor 248 through a pair of resistors 250, 252. The collector voltage of the transistor 248 is fed to the inverting input of an operational amplifier 254, the noninverting input being connected to a voltage divider circuit 256. The output of the operational amplifier 254 is fed to an output OR gate 260 by means of a conductor 262, the pulses taking a form of a pulse train of constant duration on-pulses having a frequency which is equal to $f_0$. These output pulses are fed through the OR gate to an output terminal 266 which is connected to the solenoid controlling the injector in the fuel intake portion of the engine.

Referring now to the duty cycle switch feedback circuit, it is seen that the signal pulses at output terminal 266 are fed to an averaging circuit 270 by means of a conductor 272. The averaging circuit includes a capacitor 274 and a resistor 276, the capacitor 274 being utilized to average the pulses on conductor 272. This signal is fed to the base of a transistor 278, the emitter thereof being connected to a reference voltage at node 280 established by a pair of resistors 282, 284 connected between a source of positive potential and ground. Thus, as long as the charge on capacitor 274 is low, indicating low speed or low road for the engine, the base voltage of transistor 278 will be lower than the emitter voltage to cause transistor 278 to conduct. The conduction of transistor 278 will feed a current into the base of transistor 290 to cause transistor 290 to conduct thereby lowering the potential at conductor 292 connected to the collector of transistor 290.

The conductor 292 feeds the collector voltage of transistor 290 to the base of a transistor 294 through a resistor 296. With the voltage on conductor 292 at a low level, the transistor 294 will be nonconductive to effectively disconnect the transistor 294 and the circuit connected to the collector thereof from node 298.

On the other hand, if the voltage on capacitor 274 builds up, thereby indicating a high speed, high load operation of the engine, the conduction of transistor 278 and 290 will be discontinued thereby raising the potential at the collector of transistor 290 and conductor 292, to a high positive voltage. This will cause transistor 294 to conduct thereby establishing a lower voltage level at node 298 for a given $V_m$ or mass air flow analog signal. This will cause the signal to operate in a lower voltage mode, this voltage mode being determined by resistors 300, 302 and 198. In order to provide the same amount of fuel to the engine for a specific MAP sensed pressure and engine speed, either the duration of the pulses produced by the single-shot multivibrator circuit, including amplifier 254, can be increased or a secondary injector can be enabled. In the system of FIG. 6, an output signal from transistor 290 is fed to an enable conductor 299 which is connected to the circuit controlling the secondary injector. When the secondary injector is enabled, both the primary and secondary injectors are pulsed by the train of pulses on output terminal 266. A resistor 304 is provided for hysteresis operation of transistors 278 and 290.

Referring now to FIG. 7, there is illustrated details of the cold start circuit and engine temperature sensing circuit, which circuits are utilized to override the effects of the manifold pressure and unique speed sensors in the event that a cold engine is being started and also to provide an analog signal $V_{H_2O}$ to the main circuitry described in conjunction with FIG. 6 as to the engine coolant temperature. This engine coolant temperature signal is utilized by the voltage controlled oscillator as a reference voltage in evolving $f_o$.

Specifically, the engine temperature is sensed by a resistive temperature sensor 320, i.e. a thermister, having a positive temperature coefficient connected to a positive source of direct current potential at terminal 322 at one end thereof through a resistor 324, and at the other end to ground. Thus, a voltage is developed at node 328 which is representative of the current through the temperature sensor 320. As the sensed temperature goes up, the voltage at node 328 will also go up. This voltage at node 328 is fed to an amplifier circuit 330, the amplifier circuit 330 including an operational amplifier 334. The output of amplifier 330 is fed to FIG. 6 by conductor 210, the signal on conductor 210 being directly related to the engine temperature whereby a rise in temperature causes the voltage on conductor 210 to rise.

In order to create a signal which is inversely related to the voltage representative of the engine coolant temperature and thus generate the proper signal characteristic described in conjunction with the description of FIG. 4 for use by the cold start circuit, an inverting circuit 331 is provided to provide an output signal on a conductor 332 which is a linear representation of and inversely related to the temperature of the engine coolant.

The inventing circuit 331 senses the temperature signal through a connection to the output of operational amplifier 334. This signal is fed to the base of a transistor 336 and is also available at the emitter of transistor 336. Resistors 340 and 326 connected between input D.C. potential of 9.5V and ground to form a voltage divider. The junction of these two resistors is connected to the inverting input of amplifier 334. The resistor 337 connected between the junction of resistors 340 and 326 and the emitter of transistor 336 provides some negative feedback from the output of amplifier 334. The resistor 342 connected between D.C. potential of 9.5V and emitter of transistor 336 determines the current conduction of transistor 336 and therefore the voltage drop created across the resistor 338.

Thus, with an increasing voltage at node 328, the output of operational amplifier 334 will increase to cause the voltage at the base electrode of transistor 336 to increase. This will decrease the conduction of transistor 336 by raising the voltage of the emitter electrode and decreasing the voltage at the collector electrode. Thus, as the temperature rises, the output voltage of amplifier 334 will increase and the conduction of the transistor 336 will decrease. The collector voltage will decrease with such increase of temperature. The collector signal is fed to the base of transistor 344 by conductor 332.

The temperature signal controls the conduction of transistor 344, the emitter electrode thereof being connected to a voltage source, including a pair of resistors 346, 348, the connection being made through a resistor 350. Thus, with increasing conduction of operational amplifier 334 and thus a lower voltage at the base electrode of transistor 344, the emitter-collector electrodes of transistor 344 will increase conduction. This signal is fed to a single-shot multivibrator circuit 352, to be described hereinafter.

The multivibrator circuit 352 includes a first operational amplifier 356 and a second operational amplifier 358, the outputs of the operational amplifiers as being cross coupled by means of a pair of RC networks 360, 362. Each of the operational amplifiers 356, 358 includes a latching feedback resistor 364, 366, respectively, which are utilized to latch the operation of the operational amplifiers 356, 358 in a preselected mode of operation.

Assuming that the output of operational amplifier 356 changed from a low level to a high level at a particular instant of time for purposes of discussion, the resistive portion of RC network 360, connected to the inverting input of operational amplifier 358, will cause operational amplifier 358 to switch to the lower state. Also, the resistor 364 will provide positive feedback and maintain the output of operational amplifier 356 in the high state. Further, a capacitor 370 will commence charging toward the high voltage level at the output of operational amplifier 356 through a resistor 372. When the voltage on the capacitor 370 reaches a certain level, then the current through a resistor 374 is high enough to switch the output of operational amplifier 356 to the low level. The time that the operational amplifier 356 is high is fixed and determined solely by the circuit parameters described, including resistors 364, 372, 374 and capacitor 370. Thus, the on-time for operational amplifier is set while the off-time will be variable as will be seen hereinafter.

When the operational amplifier 356 switches to the low state, current through resistor 376 will maintain the operational amplifier 356 in this low state. Also, the capacitor 370 is quickly discharged through a diode 378 to meet the level at the output of operational amplifier 356. Further, the output of operational amplifier 358 switches from a low to a high state due to the a.c. coupling through the RC circuit 360. After operational amplifier 358 switches to the high state, the current through the resistive portion of RC network 362 will maintain operational amplifier 356 in the low state and the current through resistor 366 will maintain the operational amplifier 358 in the high state. During this period a capacitor 380 will start charging through a resistor 382 from the source of positive potential at the output of operational amplifier 358.

It will be noted that the current being fed to the noninverting input of operational amplifier 358 is directly related to the engine coolant temperature due to the degree of conduction of transistor 344. Thus, the operational amplifier 358 compares the voltage at the collector electrode of transistor 344 with a charge on capacitor 380. When the charge on capacitor 380 reaches a certain value, the current through resistor 386 will be large enough to change the state of operational amplifier 358 from high to a low state. The time that the operational amplifier 358 was in the high level is a direct function of the coolant temperature due to the fact that the collector current of transistor 344 varies with the temperature of the engine coolant. Upon the transition from a high to a low state, the circuit will again revert to the state first described.

Figure 8:
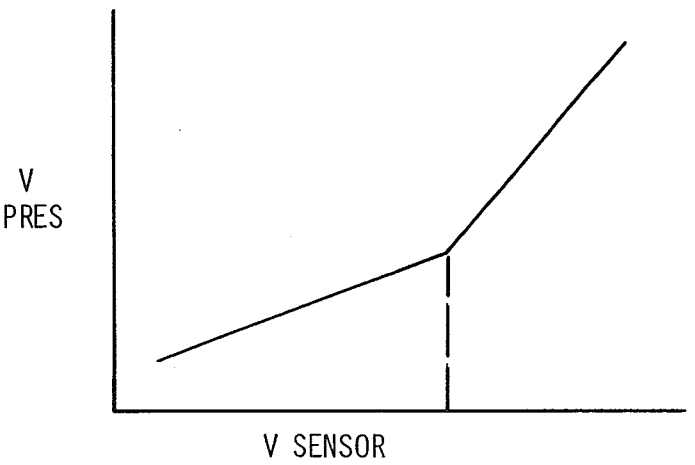
FIG. 8 is a graph illustrating the relationship of the voltage generated between the sensor voltage and the pressure voltage.

Referring now to FIG. 8, there is illustrated a graph of the operation of the break-point circuit, including transistors 138, 140, described in conjunction with FIG. 6. Specifically, it is seen that the slope of the curve is constant up to a specific torr level and then the slope increases beyond that torr level. The torr level is indicated by an output voltage level indicated at the dashed line.

While it will be apparent that the embodiments of the invention herein disclosed are well calculated to fulfill the objects of the invention, it will be appreciated that the invention is susceptible to modification, variation and change without departing from the proper scope or fair meaning of the subjoined claims.

I claim:

1. A frequency modulated fuel injection system for internal combustion engines comprising:

pressure sensing means for measuring the manifold pressure of the engine and generating a pressure electrical signal representing the manifold pressure of the engine including an operational amplifier having one input connected to the pressure sensing means and the other input connected to receive a reference signal;

means responsive to the rotational speed of the engine and generating a speed electrical signal representing said rotational speed including an operational amplifier and a unijunction transistor connected to an input of the amplifier;

function generatoı means responsive to said pressure and speed electrical signals for generating an analog signal representative of a direct function of both said pressure and said speed signals;

means for generating a reference signal;

voltage controlled oscillator means responsive to said analog signal and said reference signal for generating a frequency modulated electrical signal including a current source having a magnitude of current flow proportional to said analog signal and storage means connected to said current source, said current source charging said storage means;

pulse generator means connected to said frequency modulated electrical signal for generating an electrical pulse signal having a predetermined duty cycle depending upon the frequency of said frequency modulated signal including a multivibrator circuit having a fixed period; and injection means connected to said pulse generator means and operative in response to said electrical pulse signal for supplying the fuel demand to the engine.

2. The frequency modulated system of claim 1 wherein said analog signal is equal to a function of the product of said pressure and speed electrical signals.

3. The frequency modulated system of claim 2 wherein said reference signal generating means includes means for sensing the temperature of the internal combustion engine, said reference signal being proportional to said temperature, said signal generating means including an operational amplifier circuit having an inverted and a direct output signal as a function of the engine temperature.

4. The frequency modulated system of claim 3 wherein said temperature reference signal from said direct output varies as a direct function of said temperature and is fed to an input of said voltage controlled oscillator operational amplifier.

5. The frequency modulated system of claim 1 additionally including duty cycle switch means responsive to the frequency of said electrical pulse signal from said pulse generator means and operative to modify the pulse width of said electrical pulse signal from said pulse generator means, said switch means including a voltage divider and a switching circuit connected to said voltage divider circuit for connecting said voltage divider circuit to said multiplying means output at preselected sensed duty cycles.

6. The frequency modulated system of claim 5 wherein said duty cycle switch is connected to receive the output of said function generator means and modify said analog signal.

7. The frequency modulated system of claim 6 wherein said voltage divider circuit reduces said analog signal and reduces the frequency of said frequency modulated signal when the ratio of said pulse width to the time between pulses exceeds a predetermined value.

8. The frequency modulated fuel injection system of claim 7 wherein said injection means comprises at least one fuel injection valve positioned at the inlet of the intake manifold system of the engine and operative in response to said electrical pulse signal to supply the fuel demand to all the cylinders of the engine and a secondary fuel injection valve having an enable circuit connected to the output of said duty cycle switch for enabling said secondary fuel injection valve when said pulse width to the time between pulses exceeds said preselected amount.

9. The frequency modulated system of claim 8 wherein said duty cycle switch includes transistor means and an averaging circuit connected to said pulse generator, said averaging circuit averaging the pulses to said injector and controlling the conduction of said transistor means.

10. The frequency modulated system of claim 9 further including an output transistor connected to said voltage divider for switching said voltage divider into and out of connection with said function generator means.

11. A frequency modulated fuel injection system for internal combustion engines comprising:

pressure sensing means for measuring the manifold pressure of the engine and generating a pressure electrical signal representing the manifold pressure of the engine including an operational amplifier having one input connected to the pressure sensing means and the other input connected to receive a reference signal;

means responsive to the rotational speed of the engine and generating a speed electrical signal representing said rotational speed including an operational amplifier and a unijunction transistor connected to an input of the amplifier;

multiplying means responsive to said pressure and speed electrical signals for generating an analog signal representative of the mass air flow to the engine;

means for generating a reference signal;

voltage controlled oscillator means responsive to said analog signal and said reference signal for generating a frequency modulated electrical signal including a current source having a magnitude of current flow proportional to said analog signal and storage means connected to said current source, said current source charging said storage means;

pulse generator means connected to said frequency modulated electrical signal for generating an electrical pulse signal having a predetermined duty cycle depending upon the frequency of said frequency modulated signal including a multivibrator circuit having a fixed period;

injection means operative in response to said electrical pulse signal for supplying the fuel demand to the engine; and duty cycle switch means responsive to the frequency of said electrical pulse signal from said pulse generator means and operative to modify the pulse width of said electrical pulse signal from said pulse generator means, said switch means including a voltage divider and a switching circuit connected to said voltage divider circuit for connecting said voltage divider circuit to said multiplying means output at preselected sensed duty cycles.

12. The frequency modulated system of claim 11 wherein said duty cycle switch is connected to receive the output of said multiplier means and modify said analog signal.

13. The frequency modulated system of claim 12 wherein said voltage divider circuit reduces the mass air flow signal and reduces the frequency of said frequency modulated signal when the ratio of said pulse width to the time between pulses exceeds a predetermined value.

14. The frequency modulated fuel injection system of claim 13 wherein said injection means comprises at least one fuel injection valve positioned at the inlet of the intake manifold system of the engine and operative in response to said electrical pulse signal to supply the fuel demand to all the cylinders of the engine and a secondary fuel injection valve having an enable circuit connected to the output of said duty cycle switch for enabling said secondary fuel injection valve when said pulse width to the time between pulses exceeds said preselected amount.

15. The frequency modulated system of claim 14 wherein said duty cycle switch includes transistor means and an averaging circuit, said averaging circuit averaging the pulses to said injector and controlling the conduction of said transistor means.

16. The frequency modulated system of claim 15 further including an output transistor connected to said voltage divider for switching said voltage divider into and out of connection with said function generator means.

* * * * *